United States Patent [19]

Pogharian

[11] Patent Number: 4,924,562

[45] Date of Patent: May 15, 1990

[54] JEWELRY CLASP

[76] Inventor: Mardig V. Pogharian, 8513 Fullbright Ave., Canoga Park, Calif. 91306

[21] Appl. No.: 760,113

[22] Filed: Jul. 29, 1985

[51] Int. Cl.[5] ..... A44B 17/00

[52] U.S. Cl. ..... 24/647; 24/664; 24/234

[58] Field of Search ..... 24/647, 589, 598, 629, 24/633, 636, 643, 662, 664, 677, 234

[56] References Cited

U.S. PATENT DOCUMENTS

| | | | |
|---|---|---|---|
| 295,192 | 3/1884 | Orts | 24/647 |
| 435,597 | 9/1890 | Walder | 24/647 X |
| 468,677 | 2/1892 | Maxheimer et al. | 24/647 X |
| 731,707 | 6/1903 | Putnam | 24/598 X |
| 809,465 | 1/1906 | Roy et al. | 24/647 X |
| 1,190,383 | 7/1916 | Court | 24/647 X |
| 1,223,574 | 4/1917 | Fedczyszyn | 24/633 |
| 1,627,776 | 5/1927 | Haumerson | 24/647 X |
| 2,166,666 | 7/1939 | Rolan | 24/234 |
| 2,904,347 | 9/1959 | Tucker | 24/647 X |
| 3,638,287 | 2/1972 | Wright et al. | 24/664 X |
| 4,210,986 | 7/1980 | Williams | 24/643 |
| 4,458,392 | 7/1984 | Pogharian et al. | 24/664 |
| 4,458,393 | 7/1984 | Pogharian | 24/234 |

FOREIGN PATENT DOCUMENTS

| | | | |
|---|---|---|---|
| 1322447 | 7/1973 | United Kingdom | 24/664 |

*Primary Examiner*—Laurie K. Cranmer
*Attorney, Agent, or Firm*—John J. Hall

[57] ABSTRACT

A jewelry clasp having a hook member pivotally mounted in a housing and spring actuated to engage and disengage with a latch member insertable in the housing.

2 Claims, 2 Drawing Sheets

JEWELRY CLASP

SUMMARY OF THE INVENTION

Jewelry clasps known in the prior art are difficult to open and lack security from inadvertent opening.

The present invention is an improvement over U.S. Pat. No. 4,458,393.

The invention described and claimed herein provides an improved jewelry clasp of the hook type having a pivotally mounted hook member in a housing and spring actuated in conjunction with a latch member insertable into the housing.

The latch member has a stop formed at its bottom and an indentation at its top which is congruent with the hook.

This invention provides a very secure clasp for jewelry with the feature of being easily opened and closed when desired by the person wearing the jewelry.

It is, therefore, an object of this invention to provide a jewelry clasp which is very secure against accidental opening.

Another object of this invention is to provide a jewelry clasp which is easily opened and closed by the person wearing the jewelry.

Yet another object of this invention is to provide a jewelry clasp which is reliable in operation.

Still another object of this invention is to provide a jewelry clasp which is relatively easy to manufacture.

These and other objects will be more readily understood by reference to the accompanying description and drawings in which.

Figure 1:
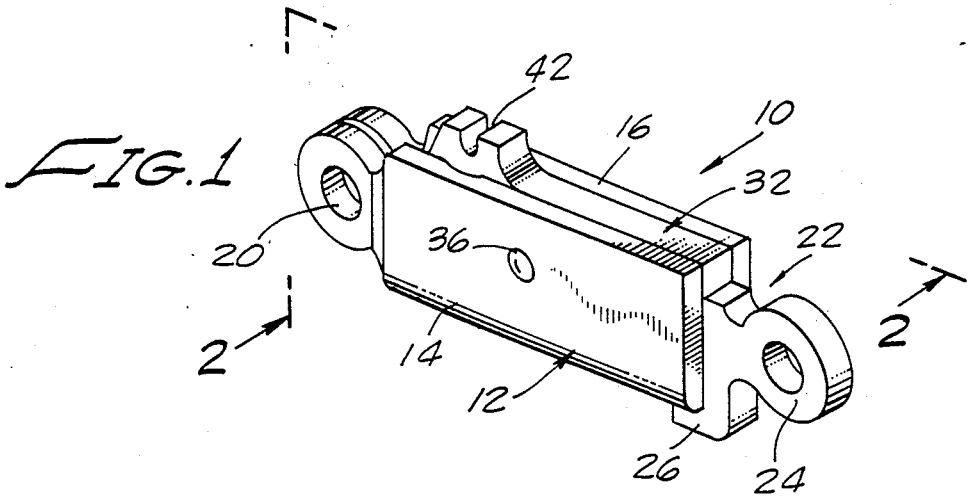
FIG. 1 is a perspective view of a prefered embodiment of the invention in a closed condition.
Figure 2:
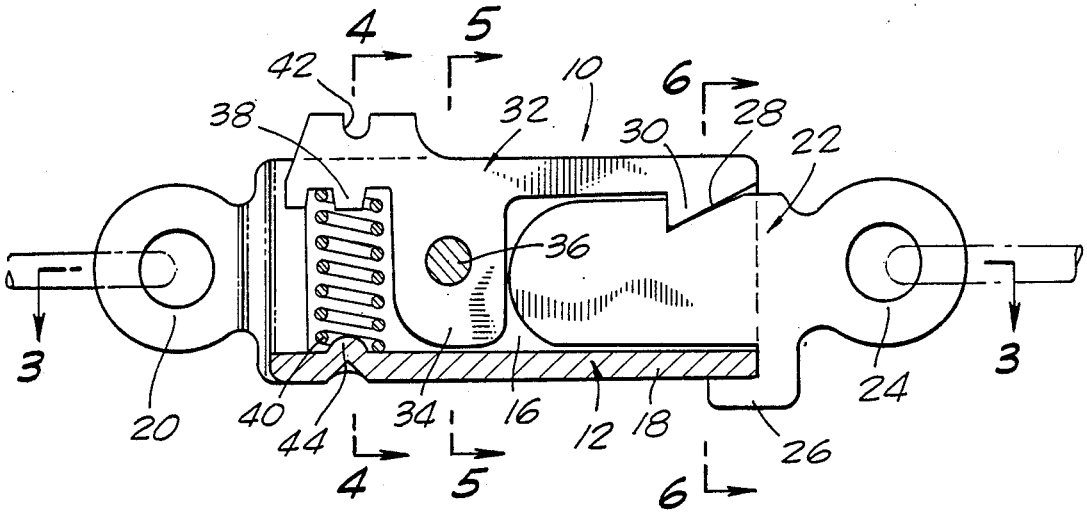
FIG. 2 is a sectional view taken on line 2—2 of FIG. 1.
Figure 3:
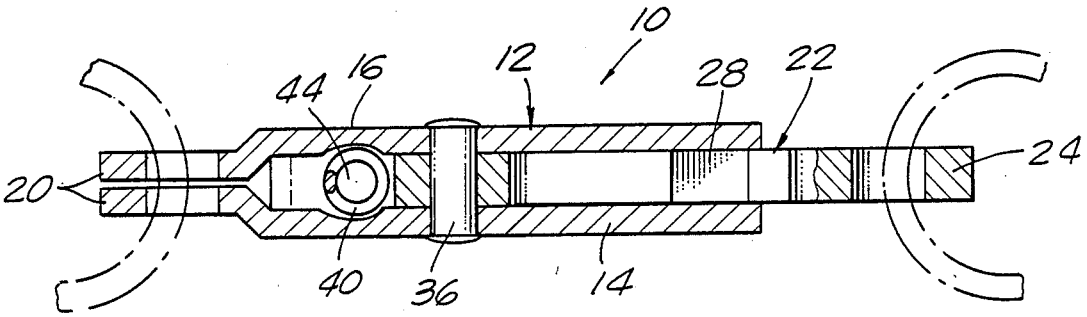
FIG. 3 is a sectional view taken on line 3—3 of FIG. 2.
Figure 4:
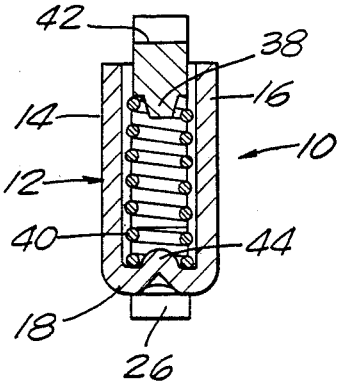
FIG. 4 is a sectional view taken on line 4—4 of FIG. 2.
Figure 5:
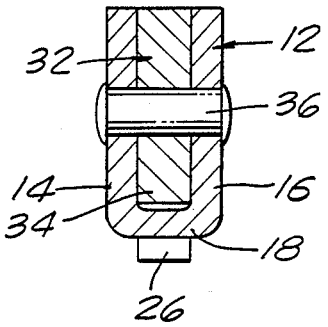
FIG. 5 is a sectional view taken on line 5—5 of FIG. 2.
Figure 6:
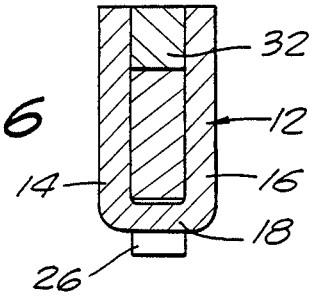
FIG. 6 is a sectional view taken on line 6—6 of FIG. 2.
Figure 7:
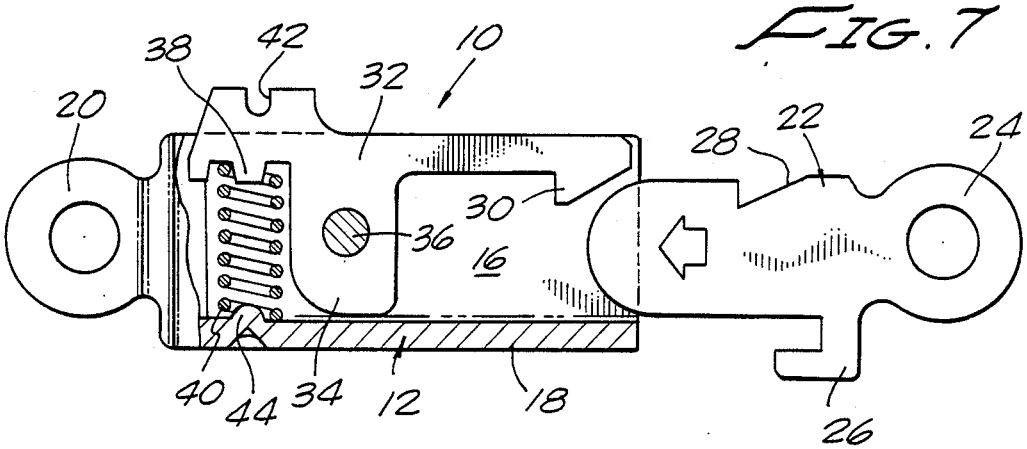
FIG. 7 is a sectional view similar to FIG. 2, but showing elements of the invention in a separated condition.
Figure 8:
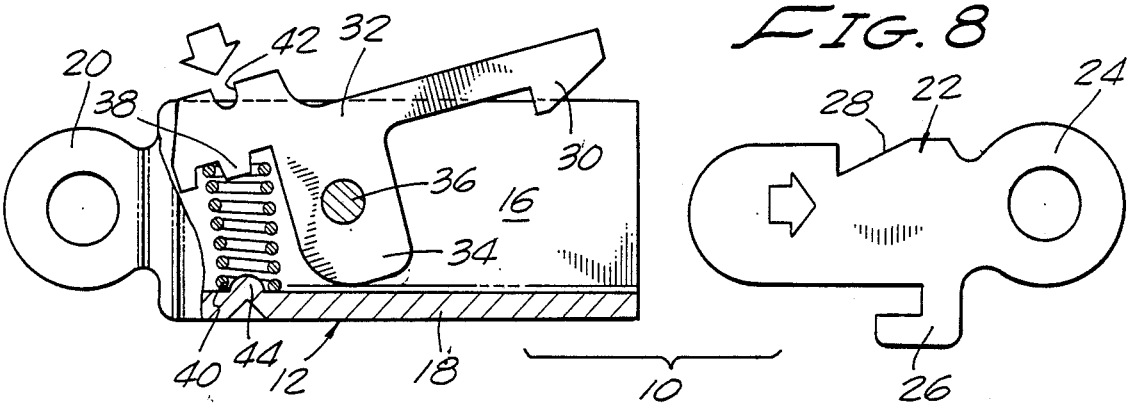
FIG. 8 is a sectional view similar to FIG. 7 illustrating the unlocking sequence of an embodiment of the invention.

The jewelry clasp 10 has a u-shaped housing 12 with two opposed and parallel side walls 14 and 16 and a bottom 18. Side wall 14 has its front end formed into eyelets 20. The outer end of housing 12 is open to receive a latch member 22.

Latch member 22 has its outer end formed into an eyelet 24 and is provided at its bottom with a stop member 26 formed to abut the outer end of housing bottom 18. The top edge of latch member 22 has a cutout portion or indentation 28 formed to receive the hook portion 30 of hook member 32.

The inner end of latch member 22 is rounded and abuts the keeper portion 34 of hook member 32. Hook member 32 is pivotally mounted by a pin 36 inside housing 12 and has a downward projection 38 at its inner end which contacts spring 40.

Hook member 32 has a groove 42 at the top of its inner end for receiving a person's fingernail or a suitable implement for pressing down the inner end of hook member 32 and for compressing spring 40.

Housing bottom 18 is provided with an upper projection or detente 44 to locate the lower end of spring 40 and prevent slippage of spring 40.

In operation, a person pushes the inner end of hook member 32 down by the person's fingernail or other implement in groove 42, thereby pivoting the hook member 32 up so that latch member 22, which is connected to one end of a chain (not shown) can be inserted.

The hook member 32 is then released, and the action of spring 40 causes the hook 30 of hook member 32 to bear against indentation 28 of latch member 22, thereby securing and firmly clasping latch member 22 and connecting both ends of a chain for jewelry.

Although I have described the invention with respect to a preferred embodiment, it is understood that various modifications and changes may be made in the location and form of the various elements without departing from the spirit and scope of the invention as defined in the following claims.

I claim:

1. A jewelry clasp comprising:

a housing having parallel side walls connected to the bottom of said housing, and having one end (being) open;

a hook member with a top surface coplanar with the tops of said parallel side walls and pivotally mounted in said housing and having a hook at its outer end;

spring means located inside the inner end of said housing, and maintained in position by its upper end abutting against a projection formed at the bottom surface of the inner end of said hook member and by its lower end abutting against a detent in the bottom of said inner end of said housing; and a latch member insertable into said housing and provided with an indentation engagable with said hook and a stop member abutting against the outer end of said bottom of said housing in the closed position of said jewelry clasp;

whereby said jewelry clasp is maintained in a closed position upon insertion of said latch member into said housing and is opened upon direct application of downward pressure to the top of said inner end of said hook member, thereby releasing said latch member.

2. A jewelry clasp according to claim 1 in which said hook member is provided with groove means at the inner end of its top surface along the axis of said spring means to facilitate the application of downward pressure to said spring means.

* * * * *